United States Patent [19]

West

[11] 3,994,450

[45] Nov. 30, 1976

[54] PLAN KEEPER

[76] Inventor: Kenneth Darrell West, 441 Sycamore Drive, Bakersfield, Calif. 93308

[22] Filed: Sept. 9, 1975

[21] Appl. No.: 611,818

[52] U.S. Cl. ..... 242/107; 242/67.3 R

[51] Int. Cl.[2] ..... B65H 75/48

[58] Field of Search ..... 242/67.1 R, 67.3 R, 242/67.4, 55, 107; 40/85, 82, 83; 206/224, 225

[56] References Cited

UNITED STATES PATENTS

| | | | |
|---|---|---|---|
| 2,638,280 | 5/1953 | Beaudrof | 242/67.3 R |
| 2,775,061 | 12/1956 | Wahlstrom | 242/67.3 R |
| 3,640,482 | 2/1972 | Hippel | 242/107 R |
| 3,884,351 | 5/1975 | James | 242/107 R |

*Primary Examiner*—Edward J. McCarthy
*Attorney, Agent, or Firm*—Clarence A. O'Brien; Harvey B. Jacobson

[57] ABSTRACT

Flexible sheets are clamped between anchoring bars and supported in a flat condition on a rectangular frame formed by a pair of spring bands interconnecting the anchoring bars with a rest bar. The sheets are rolled up into tubular form assisted by the coiling of the spring bands. The free ends of the sheets overlying the rest bar are clamped to the rest bar and retainer spring bands pivoted to the rest bar are coiled about the rolled up sheets to hold the same in a storage condition.

15 Claims, 11 Drawing Figures

PLANS

PLAN KEEPER

BACKGROUND OF THE INVENTION

This invention relates to the holding or keeping of relatively large sheets of flexible material, such as paper, in either a flat condition or in a rolled up storage condition.

Devices for rolling or unrolling flexible sheets of material are well known as disclosed, for example, in U.S. Pat. Nos. 216,654, 2,202,582 and 3,640,482. Such prior devices are not, however, specifically designed for use in storing or unrolling of relatively large sheets of material such as blueprints, maps and other plans into flat condition for reading. To meet the objectives of the present invention, the sheet material holding device must be relatively inexpensive, simple to assemble and effective in firmly holding relatively large, flexible sheets of material in a flat condition as well as to enable the orderly and easy rolling or coiling of such sheets of material into tubular form with facilities to hold the rolled up sheets in coiled condition for storage purposes.

SUMMARY OF THE INVENTION

In accordance with the present invention, the flexible sheet holding device has a generally rectangular configuration formed by a sheet anchoring assembly to which sheets are secured along one edge, a pair of parallel spaced spring bands connected to the anchoring assembly and a rest bar interconnected with the spring bands in parallel spaced relationship to the anchoring assembly. The spring bands support the sheets of material in a flat condition when unrolled or uncoiled, the free ends of the sheets overlying the rest bar. In this flat condition the spring bands are stressed but remain uncoiled because of a transverse curvature. Once coiling of the sheets of material is begun at the edge clamped between the bars of the anchoring assembly, the spring bands will coil the flexible sheets in an orderly fashion into a firm tubular form. The free ends of the sheets overlying the rest bar may then be clamped to the rest bar by a clamping bar pivotally connected to the rest bar. A pair of retainer spring bands pivotally connected to the rest bar may then be displaced from inactive positions underlying the rest bar to extended positions in which they coil about the rolled up sheets of material in order to hold the same in the storage condition. A hanger pivoted to the anchor assembly may be unfolded to an extended position for suspending the rolled up sheets of material from a hook.

These together with other objects and advantages which will become subsequently apparent reside in the details of construction and operation as more fully hereinafter described and claimed, reference being had to the accompanying drawings forming a part hereof, wherein like numerals refer to like parts throughout:

DETAILED DESCRIPTION OF A PREFERRED EMBODIMENT

Figure 1:
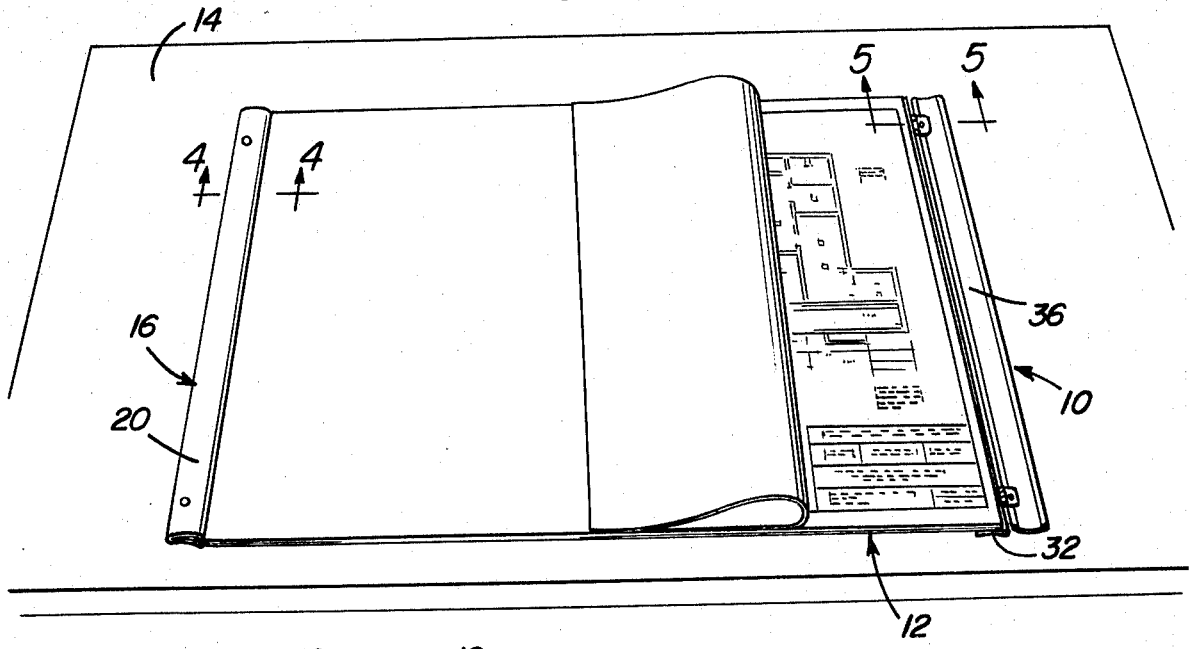
FIG. 1 is a perspective view showing the sheet material holding device of the present invention in use with the sheets of flexible material in a flat condition.
Figure 2:
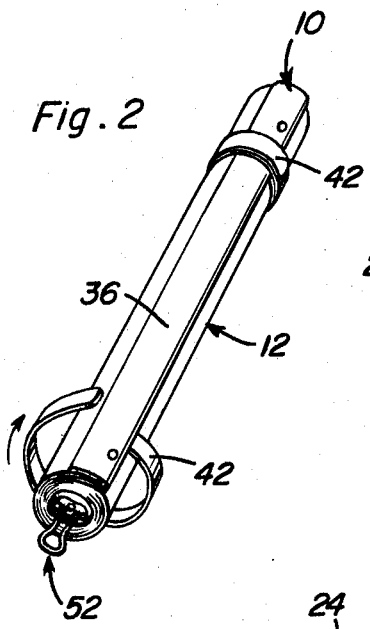
FIG. 2 is a perspective view showing the sheet material holding device in the rolled up storage condition.
Figures 6, 7, 8, 10:
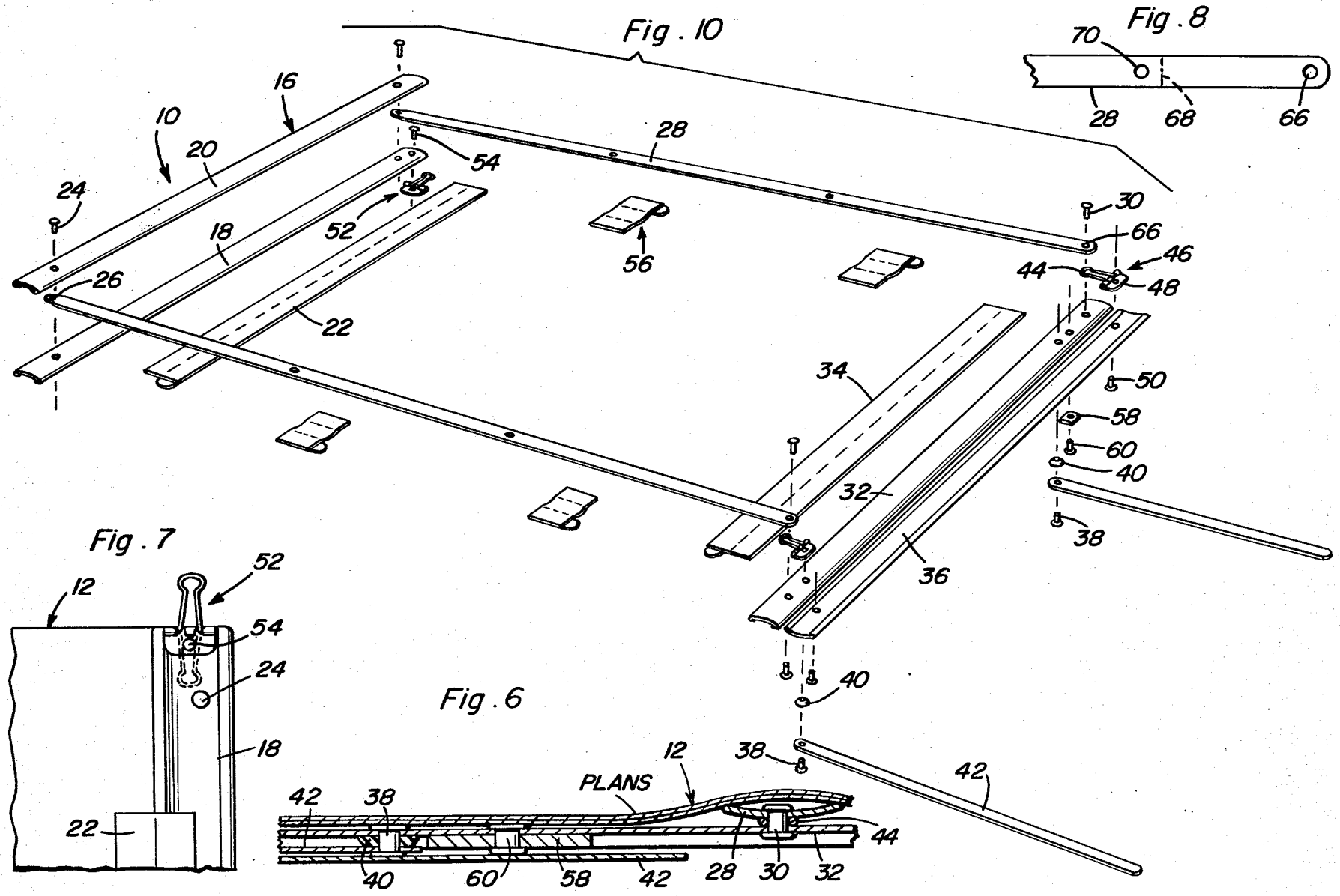
FIG. 6 is an enlarged partial sectional view taken substantially through a plane indicated by section line 6—6 in FIG. 3.
FIG. 7 is an enlarged partial bottom plan view of the sheet material holding device showing the foldable hanger associated therewith.
FIG. 8 is an enlarged elevational view of a portion of one of the coiling spring bands associated with the device.
FIG. 10 is a perspective view showing the disassembled parts of the sheet holding device.

Referring now to the drawings in detail, FIG. 1 illustrates the sheet holding device of the present invention generally referred to by reference numeral 10 holding a plurality of rectangular, flexible sheets of material 12, such as blueprints, in a flat condition on a supporting table surface 14 for viewing purposes. FIG. 2 illustrates the same flexible sheets of material rolled up in storage condition by means of the device 10. FIG. 10 illustrates the disassembled parts of th sheet material holding device in its unrolled or uncoiled condition.

With continued reference to FIG. 10, the device 10 includes an edge anchoring assembly generally referred to by reference numeral 16 formed by a pair of elongated bars 18 and 20. The bars 18 and 20 are of the same length and cross-section. Also associated with the anchoring assembly is an elongated strip of plastic 22 of somewhat shorter length than the anchoring bars 18 and 20. The anchoring bars are interconnected with each other adjacent opposite ends by rivets 24. The rivets also extend through end portions 26 of a pair of spring bands 28 clamped between the anchoring bars and extending therefrom at right angles. The other ends of the spring bands 28 are interconnected by rivets 30 to a rest bar 32 adjacent its opposite longitudinal ends, the rest bar 32 being of the same length and cross-section as the anchoring bars 18 and 20. Also associated with the rest bar 32 is an underlying strip of plastic 34. The plastic strips 22 and 34 are coated with an adhesive so as to adhere to the undersides of the anchoring bar 18 and rest bar 32, respectively. The anchoring bars 18 and 20, the spring bands 28 and the rest bar 32 when interconnected by their rivets 34 and 30 form a rectangular frame on which the sheets of material 12 are adapted to be supported in a flat condition.

As also shown in FIG. 10, a clamping bar 36 is hingedly connected to the rest bar 32 and is of the same length and cross-section except that it is transversely inverted relative to the rest bar 32 as shown in FIGS. 1 and 10. Also pivotally connected to the rest bar 32 by rivets 38 and spaced therefrom by washers 40, are a pair of retainer spring bands 42.

The rivets 30 which interconnect the ends of the spring bands 28 with the rest bar 32, also hold assembled thereon, the eye formations 44 extending from hinge clips 46 having their base plates 48 secured to the clamp bar 36 adjacent the opposite longitudinal ends by means of the rivets 50. A third hinge clip 52 constituting a foldable hanger is secured by means of a rivet 54 to the underside of the anchoring bar 18 adjacent one longitudinal end.

As will be explained hereafter, the spring bands 28 are secured to a bottom sheet of the sheets of material 12 by means of plastic elements 56 having adhesive coatings thereon. The retainer spring bands 42 are held in their inactive positions underlying the rest bar 32 by means of a magnetic latch element 58 as will be explained hereafter in detail, the magnetic latch element 58 being secured to the rest bar 32 by means of a rivet 60.

Figure 4:
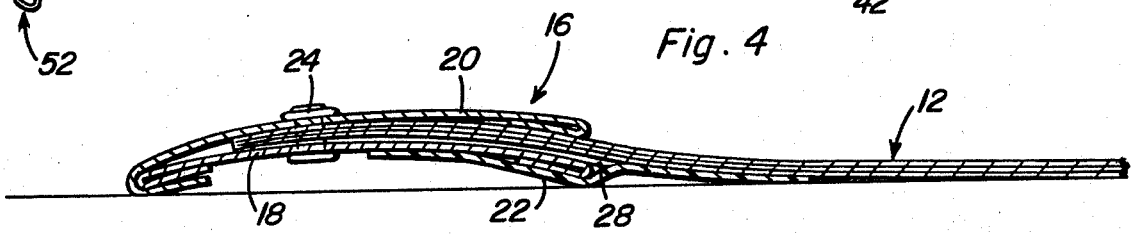
FIG. 4 is an enlarged partial sectional view taken substantially through a plane indicated by section line 4—4 in FIG. 1.

As more clearly seen in FIG. 4, the anchoring bars 18 and 20 which form the anchoring assembly 16, are interconnected adjacent the opposite longitudinal ends by the rivets 24 which are located closer to the outer longitudinal edges of the bars. Both parallel spaced edges of the bars are beaded or crimped to form a smooth edge and have a transverse curvature. Bars 18 and 20 when assembled as shown in FIG. 4 will have their intermediate portions spaced from each other while the outer edge portions are in contact with each other. The sheets of material 12 are inserted between the inner edge portions of the anchoring bars and are held clamped therebetween Further, the adhesive coated strip 22 holds the bottom sheet of the sheets of material 12 secured to the anchoring assembly, since half of it underlies the bottom anchoring bar 18 and extends longitudinally thereof between the spring bands 28.

Figure 9:
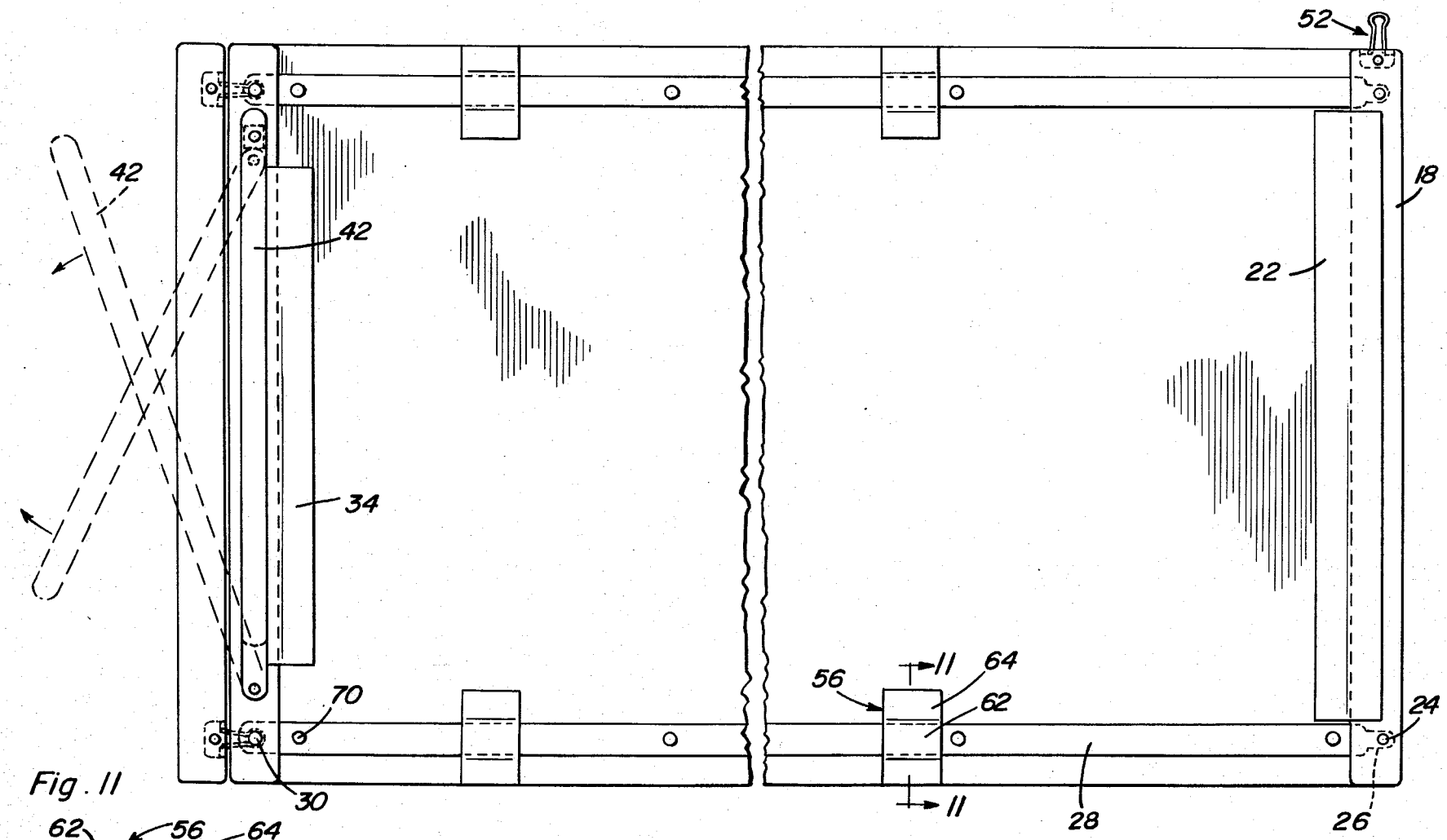
FIG. 9 is a bottom plan view of the sheet holding device.
Figure 11:
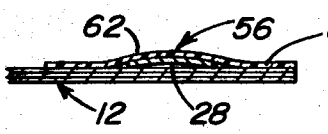
FIG. 11 is an enlarged partial sectional view taken substantially through a plane indicated by section line 11—11 in FIG. 9.

Referring now to FIGS. 9 and 11, the spring bands 28 are made of an elastically yieldable material, such as steel, and are stressed so as to roll up into a coil. The spring bands 28 nevertheless repose in the elongated straight condition shown because of a transverse curvature. Each of the spring bands is secured to the bottommost of the sheets by the plastic elements 56 having curved intermediate portions 62 and adhesive side portions 64. Openings are formed in the end portions 26 of the spring bands 28 for receiving the anchoring bar assembly rivets 24. The opposite end portions of the spring bands 28 are also formed with openings 66 for receiving the rivets 30. As shown in FIG. 8, the spring bands 28 may be cut to a shorter length along cut lines 68 adjacent to intermediate holes 70 in order to form a smaller dimension frame to accommodate smaller size sheet material.

Figure 5:
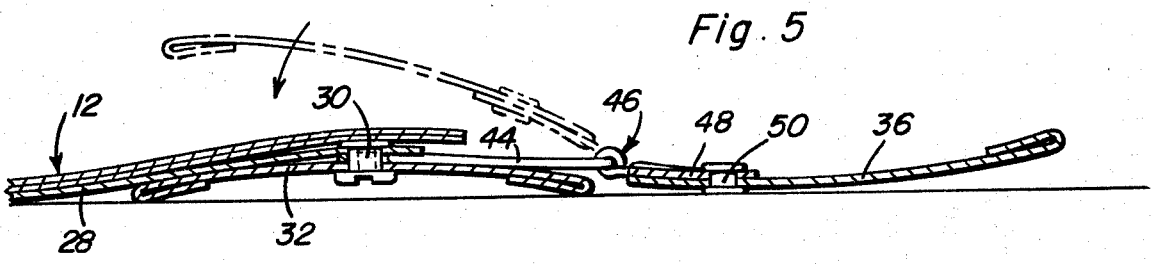
FIG. 5 is an enlarged partial sectional view taken substantially through a plane indicated by section line 5—5 in FIG. 1.

The rest bar 32 as more clearly seen in FIG. 5, has a transverse curvature like the anchoring bars 18 and 20 so that the concave face thereof faces downwardly as in the case of both of the anchoring bars 18 and 20. The parallel spaced edge portions of the rest bar are also crimped or beaded to form smooth edges. The rivets 30 extend centrally between the longitudinal edge portions adjacent to the ends of the rest bar in order to hingedly connect the clamp bar 36 thereto through the hinge clips 46. In the open position shown, the clamp bar 36 has its concave face facing upwardly. The clamp bar may be displaced toward its closed position as shown by dotted line in FIG. 5 in order to engage the free ends of the sheets 12 overlying the rest bar 32.

Figure 3:
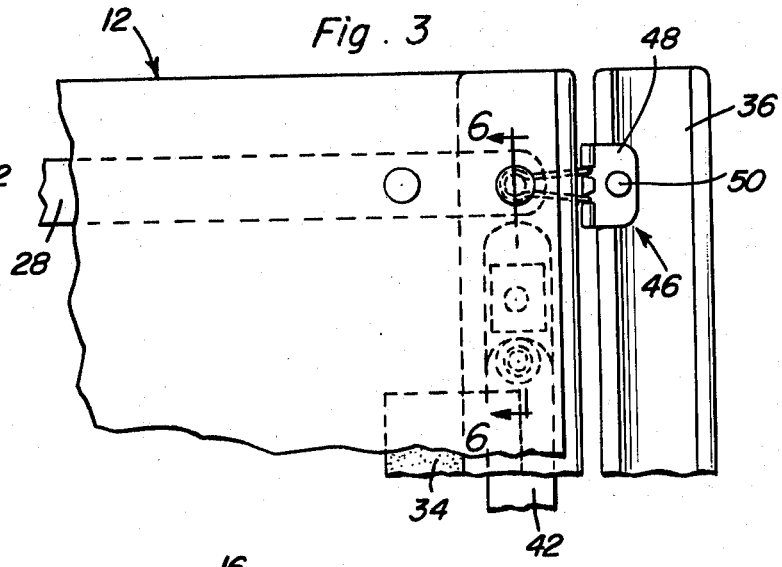
FIG. 3 is an enlarged partial top plan view of the sheet material device in the flat condition of the flexible sheets.

As shown in FIGS. 3 and 6, the retainer spring bands 42 are pivotally connected by means of the rivets 38 to the underside of the rest bar 32 spaced inwardly from the rivets 30 through which the rest bar is connected to the spring bands 28. The retainer spring bands 42, as shown in FIG. 6, underlie the rest bar 32 one on top of the other with one of the retainer spring bars being yieldably held in position by means of the magnetic latch element 58 secured by means of the rivet 60 to the underside of the rest bar. The retainer spring bands may be pivotally displaced, as shown by dotted line in FIG. 9, to positions extending parallel to the spring bands 28. In such extended positions, the pre-stress in the retainer spring bands will cause them to coil about the rolled up sheets of material as shown in FIG. 2 in order to hold the same in the storage condition. The retainer spring bands are swung out from the inactive positions underlying the rest bar after the sheets of material have been rolled up. The sheets of material rolled up by the device 10 in the storage condition may be suspended from a hook by unfolding of the hanger device 52 which is secured by means of the rivet 54 to the concave underside of the anchoring bar 18 at one end, as more clearly seen in FIG. 7.

With the device 10 in the flat condition, as shown in FIG. 1, the sheets of material will be held flat on the generally rectangular frame formed by the anchoring assembly 16, the rest bar 32 and the spring bands 28. One edge portion of the sheets of material will be clamped between the anchoring bars of the anchoring assembly 16 while the free ends will rest on the upper convex face of the rest bar 32. The sheets of material may be rolled up by starting coiling with the anchoring bar assembly 16. As the sheets of material are being rolled up or coiled, the transverse curvature of the spring bands 28 are flattened so that the longitudinal stress in the spring bands may take over and assist in the coiling or rolling up of the sheets of material. The sheets of material will thereby be rolled up into a tubular form as shown in FIG. 2 in an orderly fashion. The free ends of the sheets of material may then be clamped onto the rest bar by folding the clamp bar 36 thereover, as shown by dotted line in FIG. 5. The clamp bar will then assume the position overlying the rest bar 32, as shown in FIG. 2. The retainer spring band 42 may then be pivoted outwardly from their inactive positions underlying the rest bar. The retainer spring bands will then coil about the rolled up assembly in view of the longitudinal pre-stress therein and embrace the rolled up assembly as shown in FIG. 2 to hold the same in the storage condition.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A device for holding flexible sheets of material in a flat or in a rolled up storage condition, comprising anchoring means for engaging the material along one edge, a rest bar on which the material lies in the flat condition, spring means interconnecting the anchoring means and the rest bar in spaced relation to each other for alternatively supporting the material in the flat and storage conditions, and means connected to the rest bar for clamping the material thereto in the storage condition.

2. The combination of claim 1 wherein said spring means includes at least one elongated band longitudinally stressed when supporting the material in the flat condition and unstressed when coiled, said band having a transverse curvature resisting coiling only when supporting the material in the flat condition.

3. The combination of claim 2 including retainer means connected to the rest bar and displaceable from an inactive position to an extended position for coiling about the material to hold the same in the storage condition.

4. The combination of claim 3 wherein said retainer means includes at least one spring band pivotally connected to the rest bar and longitudinally stressed to coil about the rolled up sheets of material in the storage condition.

5. The combination of claim 4 wherein said anchoring means includes a pair of bars made of an elastic material, said bars having a transverse curvature between spaced edge portions, and means securing said bars to each other at locations closer to one of the edge portions, the flexible sheets of material being clamped between the other of the edge portions.

6. The combination of claim 5 including foldable hanger means connected to one of the bars of the anchoring means.

7. The combination of claim 6 including latch means mounted on the rest bar for holding the retainer means in the inactive position.

8. The combination of claim 1 including retainer means connected to the rest bar and displaceable from an inactive position to an extended position for coiling about the material to hold the same in the storage condition.

9. The combination of claim 8 wherein said retainer means includes at least one spring band pivotally connected to the rest bar and longitudinally stressed to coil about the rolled up sheets of material in the storage condition.

10. The combination of claim 9 including latch means mounted on the rest bar for holding the retainer means in the inactive position.

11. The combination of claim 8 including latch means mounted on the rest bar for holding the retainer means in the inactive position.

12. The combination of claim 1 wherein said anchoring means includes a pair of bars made of an elastic material, said bars having a transverse curvature between spaced edge portions, and means securing said bars to each other at locations closer to one of the edge portions, the flexible sheet material being clamped between the other of the edge portions.

13. The combination of claim 12 including foldable hanger means connected to one of the bars of the anchoring means.

14. The combination of claim 1 including foldable hanger means connected to anchoring means.

15. A device for holding a flexible sheet of material in a flat or in a rolled up storage condition, comprising anchoring means for engaging the material along one edge, a rest bar on which the material lies in the flat condition, spring means interconnecting the anchoring means and the rest bar in spaced relation to each other for alternatively supporting the material in the flat and storage conditions, and retainer means connected to the rest bar and displaceable from an inactive position to an extended position for coiling about the material to hold the same in the storage condition.

* * * * *